United States Patent [19]

Takase

[11] 4,380,979

[45] Apr. 26, 1983

[54] IDLING REVOLUTION CONTROL DEVICE FOR AN INTERNAL COMBUSTION ENGINE

[75] Inventor: Sadao Takase, Yokohama, Japan

[73] Assignee: Nissan Motor Co., Ltd., Yokohama, Japan

[21] Appl. No.: 232,545

[22] Filed: Feb. 9, 1981

Related U.S. Application Data

[63] Continuation-in-part of Ser. No. 100,568, Dec. 5, 1979, abandoned.

[30] Foreign Application Priority Data

Dec. 6, 1978 [JP] Japan ..... 53-149927

[51] Int. Cl.[3] ..... F02D 1/04

[52] U.S. Cl. ..... 123/339; 123/340; 123/341

[58] Field of Search ..... 123/339, 340, 341

[56] References Cited

U.S. PATENT DOCUMENTS 3,964,457 6/1976 Coscia ..... 123/339

FOREIGN PATENT DOCUMENTS 2004670 4/1979 United Kingdom ..... 123/339

*Primary Examiner*—Raymond A. Nelli

*Attorney, Agent, or Firm*—Schwartz, Jeffery, Schwaab, Mack, Blumenthal & Koch

[57] ABSTRACT

An idling rpm control device for an internal combustion engine for controlling idling rpm of the engine depending upon operating parameters, comprises range detecting means for detecting a range of variations in idling rpm of the engine. According to the invention if an rpm variation range is more than a predetermined value, an air-fuel ratio of mixture is controlled toward a richer mixture and as the result if the range is increased, the air-fuel ratio is controlled toward a leaner mixture, thereby minimizing the rpm variation range to improve operation of a vehicle equipped with the engine.

4 Claims, 6 Drawing Figures

IDLING REVOLUTION CONTROL DEVICE FOR AN INTERNAL COMBUSTION ENGINE

REFERENCE TO RELATED APPLICATION

This application is a continuation-in-part of my copending application Ser. No. 100,568, filed Dec. 5, 1979, now abandoned.

BACKGROUND OF THE INVENTION

1. Field of the Invention

The present invention relates to an idling rpm control device for an internal combustion engine, particularly an automotive engine, and more particularly to a device for decreasing variations in rpm of an engine.

2. Description of the Prior Art

Recently, it has been necessary to control idling revolutions per minute (rpm) of engines precisely in order to improve the purification of exhaust gases and to decrease the fuel consumption. For this purpose, a method has been proposed which utilizes an arithmetic circuit including a micro computer or the like, which compares actual idling rpm with values previously stored in a memory of the arithmetic circuit to produce a signal for decreasing or increasing air supply when the actual rpm is higher or lower than the stored value, thereby controlling the air supply and hence the rpm of the engine in such a feedback control manner. As an amount of fuel supply (for example amount of fuel injection) depends upon an amount of air supply, a control of the amount of air supply results in a control of engine rpm.

With hitherto used control devices such as above described, however, it is impossible to eliminate periodic variations in rpm of engines, although it is possible to control average rpm to desired values.

The periodic variation in rpm is partly caused by irregular combustion in an engine. In other words, in the event that a mixture is "rich" or "lean" or a fuel-air ratio of the mixture is higher or lower than a desired fuel-air ratio, the combustion of the mixture in the engine becomes unstable with resulting variations in rpm.

With the hitherto used idling an rpm control device as above described, since only an amount of air supply is feedback controlled and an amount of fuel previously determined corresponding to the amount of air supply is supplied, there is a tendency for variations in rpm to occur due to irregular combustion, with the result that passengers often feel uncomfortable.

SUMMARY OF THE INVENTION

It is an object of the invention to provide an improved idling rpm control device for an internal combustion engine which solves all the problems in the prior art.

It is another object of the invention to provide an improved idling rpm control device for an internal combustion engine, which detects ranges of variation in rpm and feedback controls fuel-air ratios of mixtures so as to make the ranges of variation smaller.

An idling rpm control device for an internal combustion engine for controlling idling rpm depending upon operating parameters of the engine according to the invention comprises an rpm range detecting means for detecting a range of variations in idling rpm of the engine and fuel control means for changing a fuel-air ratio of mixture to decrease said range of variations in idling rpm.

In order that the invention may be more clearly understood, preferred embodiments will be described, by way of example, with reference to the accompanying drawings.

DETAILED DESCRIPTION OF THE PREFERRED EMBODIMENT

Figure 1:
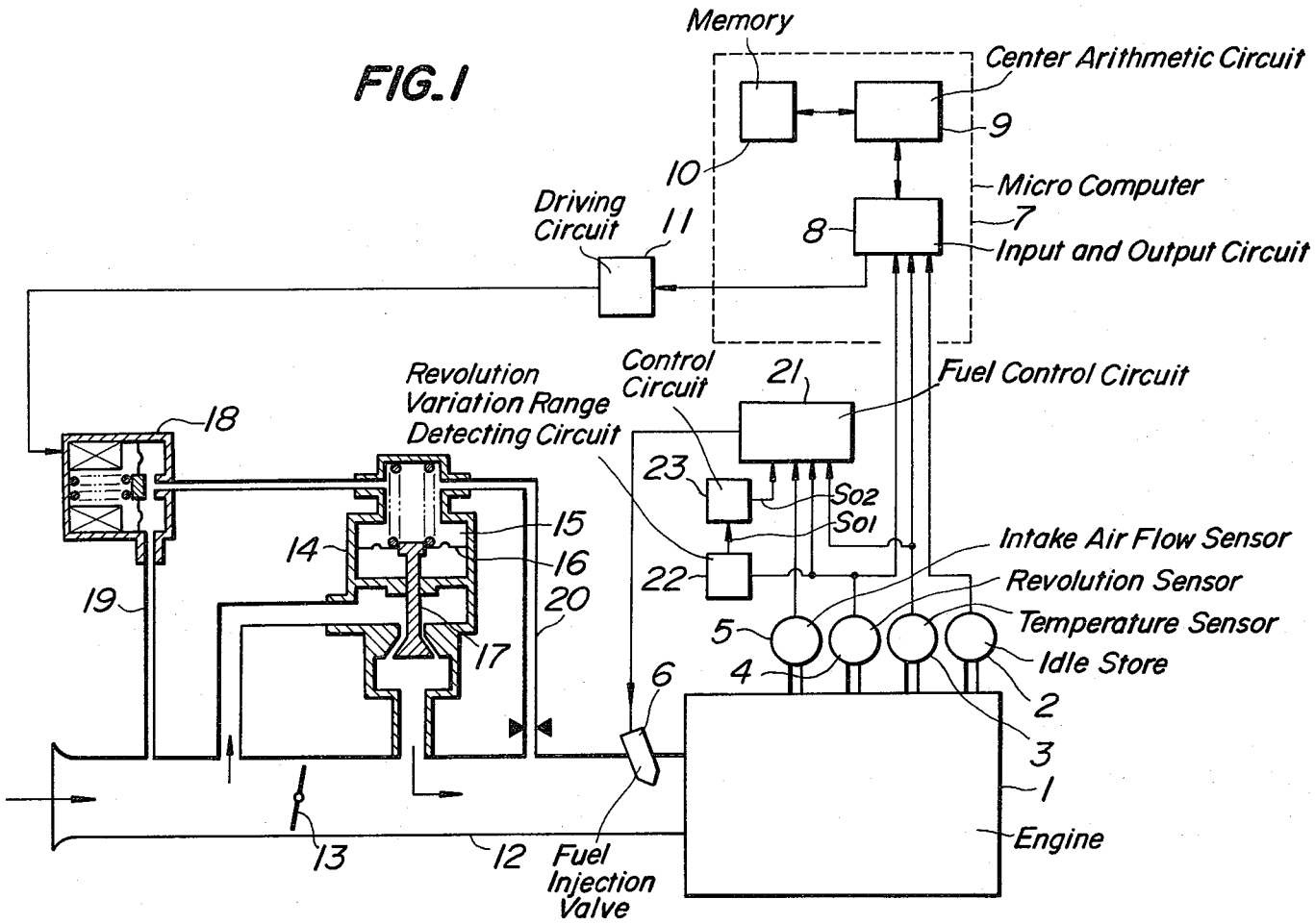
FIG. 1 illustrates an arrangement of one embodiment of the device according to the invention.

Referring to FIG. 1 illustrating a preferred embodiment of the invention, an engine body 1 comprises an idle sensor 2 (for example, a switch operative when a throttle valve is fully closed) for detecting a no-load condition of the engine, a temperature sensor 3 for detecting temperature of the engine, a revolution sensor 4 for detecting revolutions of the engine, an intake air flow sensor 5 for detecting intake air flow rate for the engine and a fuel injection valve 6. A micro computer 7 comprises therein an input and output circuit 8, a center arithmetic circuit 9 and a memory 10.

Respective signals from the idle sensor 2, temperature sensor 3 and revolution sensor 4 are inputted into the micro computer 7 from which signals are fed to a driving circuit 11 to control the rpm of the engine to that previously stored in the memory 10 corresponding to temperatures of the engine when idling.

On the other hand, upstream and downstream portions of a throttle valve 13 provided in an intake tube 12 of the engine are connected to each other through a bypass including an air supply valve 14. A solenoid valve 18 closes and opens intermittently to bring an atmosphere tube 19 and a negative pressure tube 20 into and out of communication with each other. The pressure in an air chamber 15 of the air supply valve 14 connected between the negative pressure tube 20 and solenoid valve 18 varies, therefore, depending upon the duration of opening of the solenoid valve 18. In other words, the longer the period of time the solenoid valve is kept opened, the higher is the pressure in the air chamber 15. In response to the variation in pressure in the air chamber 15, a diaphragm 16 and a valve member 17 connected thereto move vertically as viewed in the drawing to change the air supply flow to the engine through the air supply valve 14. Accordingly, by controlling the duty factor of driving pulses from the driving circuit 11 to the solenoid valve 18 by means of the signals from the micro computer 7, the air supply flow and hence the rpm of the engine when idling can be controlled. The signal from the revolution sensor 4 is supplied to the micro computer 7 which performs a feedback control for making the actual rpm equal to a desired value. A signal indicating the normal operation of an air conditioner may be given to the micro computer 7 as one of loads acting upon the engine.

On the other hand, the signals from the temperature sensor 3, revolution sensor 4 and intake air flow sensor 5 are supplied to a fuel control circuit 21 which calculates a fuel supply corresponding to an intake air flow rate per unit revolution and adds, if required, a temperature compensation to the calculated fuel supply to produce a driving pulse which actuates the fuel injection valve 6 to supply a determined fuel to the engine 1.

The signal from the revolution sensor 4 is then supplied to a revolution variation range detecting circuit 22 which produces a signal $S_{01}$ corresponding to the variation range in rpm of the engine. A control circuit 23 generates a signal $S_{02}$ for changing the fuel-air ratio when the signal $S_{01}$ or the rpm variation range is more than a determined value. Upon receipt of the signal $S_{02}$ by the fuel control circuit 21, the fuel-air ratio is changed, for example, to increase the fuel, and then if the value of the signal $S_{01}$ becomes smaller (the rpm variation range becomes smaller), the control of increasing the fuel-air ratio may be continued. In contrast herewith, when the fuel-air ratio is changed to increase the fuel in the same manner, if the value of the signal $S_{01}$ becomes larger, the fuel-air ratio should be changed to decrease the fuel. When the value of the signal $S_{01}$ becomes less than a determined value, the signal $S_{01}$ is kept at that value.

The fuel control circuit 21 serves to change the fuel-air ratio of the mixture, that is, the ratio of fuel supply to the intake air flow rate in response to the signal $S_{02}$.

The control of the fuel-air ratio of the mixture according to the rpm variation range in the above manner prevents the variation in rpm of the engine resulting from an irregular combustion of fuel-air mixture due to an improper fuel-air ratio, thereby making stable the idling of the engine.

The micro computer 7 may be used in a time sharing manner to provide functions equivalent to those of the fuel control circuit 21, revolution variation range detecting circuit 22 and control circuit 23 without providing the particular circuit for these circuits 21, 22 and 23.

Figure 2:
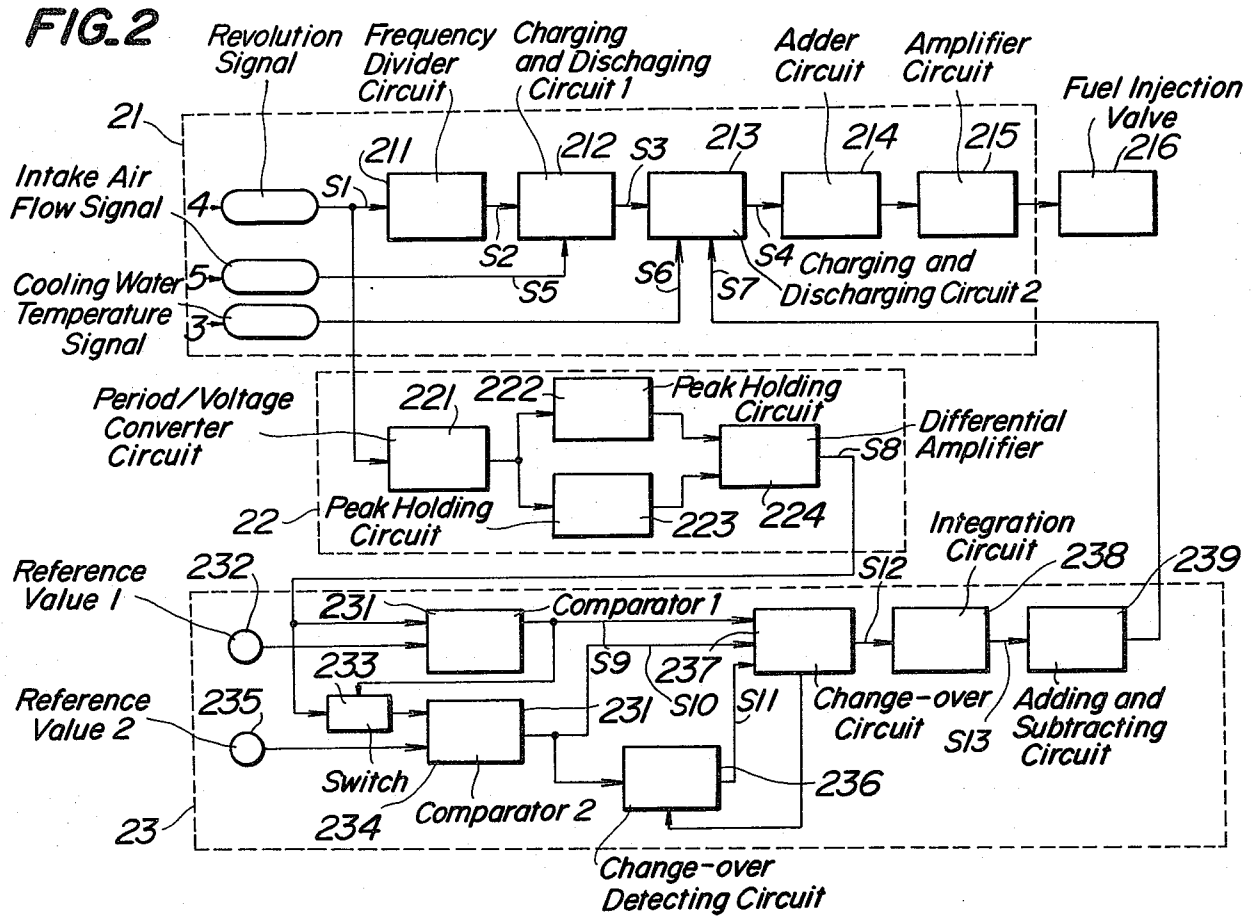
FIG. 2 is block diagrams illustrating a fuel control circuit, a an rpm variation range detecting circuit and control circuit used in the device according to the invention.
Figure 3:
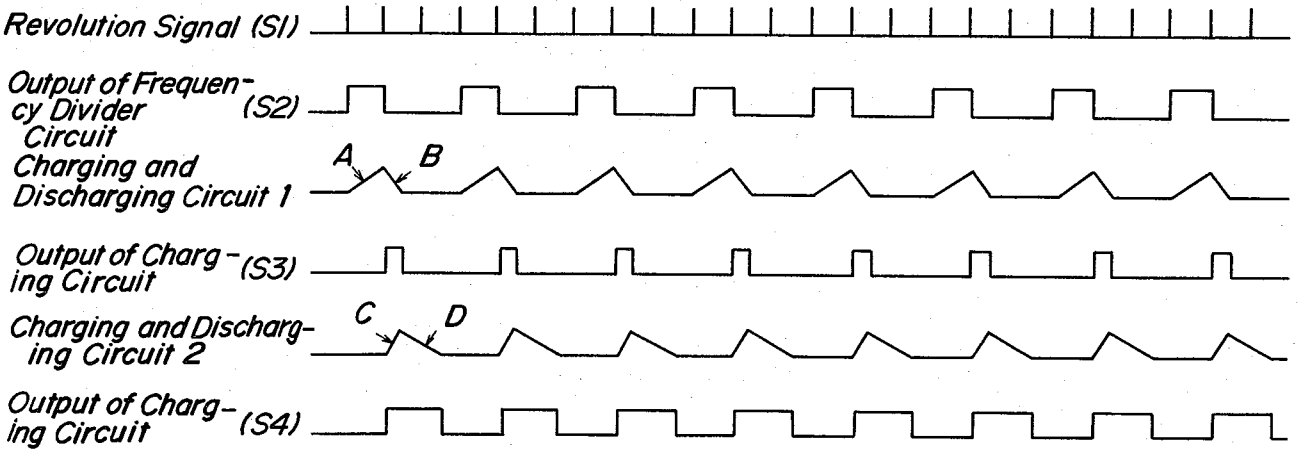
FIG. 3 illustrates wave forms of signals in the fuel control circuit shown in FIG. 2.

The fuel control circuit 21 operates in a manner as shown in FIGS. 2 and 3 illustrating its constitution in a block diagram and wave forms in operation, respectively. Revolution signals $S_1$ from the revolution sensor 4 provided on the engine 1 (for example pulse signals per 120° of crank angle rotation in the case of six cylinders ) are inputted into a frequency divider circuit 211 which produces signals $S_2$ whose pulse widths correspond to revolutions of the engine per minute which are fed to a first charging and discharging circuit 212. The first charging and discharging circuit 212 is charged at a predetermined gradient A while the $S_2$ is at a higher level, and is discharged at a gradient B corresponding to a voltage level of a signal $S_5$ from the intake air flow sensor 5 to produce a pulse signal $S_3$. The pulse width of the signal $S_3$ (at a high level) is a reference value of fuel to be supplied determined by the engine rpm and intake air flow. The signal $S_3$ is fed to a second charging and discharging circuit 213 which is charged at a gradient C corresponding to a voltage level of an engine cooling water temperature signal $S_6$ and is discharged at a gradient D corresponding to a voltage level of a separate signal $S_7$ to produce a pulse signal $S_4$. The pulse width of the signal $S_4$ (at a high level) indicates a fuel injection amount. The fuel amount is compensated depending upon various operating conditions in start, acceleration or high load condition, for which means are not shown. An adder circuit 214 adds a pulse width to compensate the fuel amount actually injected which would vary owing to variation in correspondence speed of a fuel injection valve 216 corresponding to voltage of a battery. An amplifier circuit 215 amplifies power to drive the fuel injection valve 216 which is indicated by the numeral 6 in FIG. 1.

The revolution variation range detecting circuit 22 is constructed in a manner shown in the block in FIG. 2. A period/voltage converter circuit 221 consists of an integration circuit and a sample holding circuit, so that the integration circuit is actuated every period of the rotation signal and its output voltage is held. In other words, the period/voltage converter circuit 221 receives the revolution signals whose periods are converted into voltage signals which are in turn fed to first and second peak holding circuits 222 and 223. The first peak holding circuit 222 consists of resistors and condensers to hold the maximum value of the input voltage with a determined time constant. The second peak holding circuit 223 is similar in construction to the first circuit 222 to hold the minimum value of the input voltage with a determined time constant. Outputs of the first and second circuits 222 and 223 are inputted into a differential amplifier 224 in which a difference between the outputs of the first and second circuits 222 and 223 are obtained to produce as outputs, rpm variation range signals $S_8$.

The control circuit 23 is constructed in a manner shown in a block in FIG. 2. The rpm variation range signal $S_8$ is inputted into a first comparator 231 into which is also inputted a first reference value (232) for judging the extent of the rpm variation range. The first comparator 231 generates a high level voltage signal if the input signal $S_8$ is more than the first reference value (232) and a low level signal ($S_9$) when the input signal $S_8$ is less than the first reference value (232). If the output of the first comparator 231 is at a high level, a switch 233 is operated to feed the signal $S_8$ into the second comparator 234 which is also inputted a second reference value 235 for judging an increase in the rpm variation range. The second comparator 234 produces a high level signal when the input $S_8$ is more than the second reference value and a low level signal ($S_{10}$) when the input $S_8$ is less than the second reference value. A change-over detecting circuit 236 produces a high level voltage signal when the output of the second comparator 234 is changed over from the high to low level and produces a low level signal ($S_{11}$) in the other case. A change-over circuit 237 receives the signals $S_9$, $S_{10}$ and $S_{11}$ to produce the following three kinds of voltage signals $S_{12}$ depending upon statuses of the signals $S_9$, $S_{10}$ and $S_{11}$. That is, circuit 237 produces a first voltage signal when both the signals $S_9$ and $S_{10}$ are at low levels, a second voltage signal when the signal $S_9$ is at a high level and $S_{10}$ is at a low level, and a third voltage signal when both the signals $S_9$ and $S_{11}$ are at high levels. In case of both the signals $S_9$ and $S_{10}$ being at low levels, the output of the change-over detecting circuit 236 becomes a low level. The output $S_{12}$ of the change-over circuit 237 is inputted into an integration circuit 238. When the first voltage signal is inputted in the integration circuit 238, it does not perform its integrating operation but produces a determined voltage signal. When the second voltage signal is inputted, the integration circuit operates to increase the voltage output at a predetermined time constant. When the third voltage signal is inputted, the integration circuit operates to decrease the voltage output at a predetermined time constant. The output $S_{13}$ of the integration circuit 238 is inputted into an adding and subtracting circuit 239 in which adding and subtracting of the outputs of the integration circuit 238 with predetermined voltage are performed. The output of the adding and subtracting circuit is an input signal $S_7$ to the second charging and discharging circuit 213 in the block 21.

A discharging gradient D of the second charging and discharging circuit 213 in the block 21 in FIG. 2 varies depending upon the voltage level of the signal $S_7$ in a manner such that an increase in the voltage level of the signal $S_7$ makes the gradient D more flat and a decrease renders the gradient more abrupt. Thus the variation in the voltage level of the signal $S_7$ can change the amount of the fuel injection.

With the above arrangement, when an rpm variation range is more than the first reference value, at first an air-fuel ratio is varied toward a rich side and as the result, if the rpm variation range does not increase, then the ratio is varied toward the rich side still further. If the range increases when the ratio is varied toward the rich side, then the ratio is varied toward a lean side. When the rpm variation range has become less than the first reference value, the compensation of the air-fuel ratio is stopped.

Wave forms of the signals $S_1$–$S_4$ are shown in FIG. 3.

Figure 4:
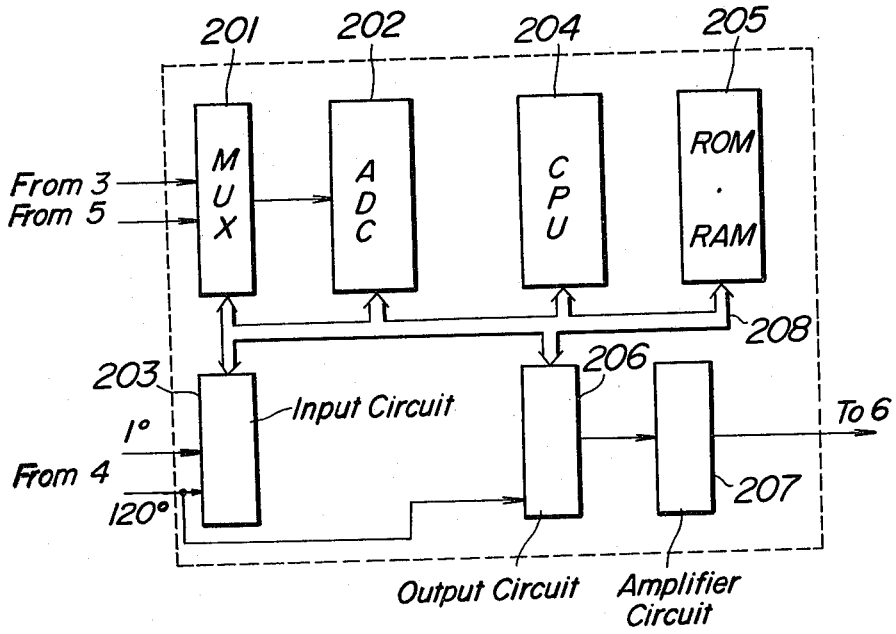
FIG. 4 shows other embodiment of the circuits shown in FIG. 3, utilizing micro computers.
Figure 5:
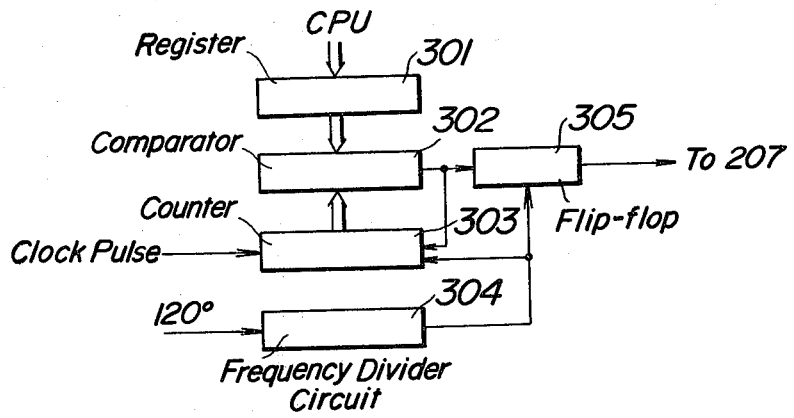
FIG. 5 illustrates an output circuit used in the circuit shown in FIG. 4.

FIGS. 4 and 5 illustrate one embodiment of the circuits 21, 22 and 23 utilizing micro computers, whose operation will be explained hereinafter.

A multiplexer 201 receives analog signals from the temperature sensor 3 and intake air flow sensor 5 which are alternately selected to be fed to an analog-to-digital converter 202. The selection of the signals is effected according to programs housed in a read-only memory (ROM) 205. The analog-to-digital converter 202 converts the signals from the multiplexer into digital signal (binary digit). An input circuit 203 consists of a timer, a counter and a latch circuit. The revolution sensor 4 is a crank angle sensor secured to a crankshaft of the engine and produces pulse signals for example every 120° and 1° of the crank angle in case of six cylinders. The input circuit 203 counts pulse signals of 1° from the revolution sensor 4 during a predetermined period of time given by the timer. The counted values are latched by the latch circuit on the termination of counting.

An arithmetic operation for the amount of fuel injection is effected in a central processing unit (CPU) 204 in the following manner. A fuel amount determined by an intake air flow detected by the intake air flow sensor and an engine revolution detected by the crank angle sensor is referred to as a reference fuel injection amount Tp. The reference fuel injection amount Tp is modified with compensations according to engine conditions or for fuel cut, or other compensations according to feed back of the air-fuel ratio with an oxygen sensor or battery voltage to obtain a fuel injection amount for existing engine conditions. A signal corresponding to such a fuel injection amount is fed to the fuel injection valve. This fuel injection amount is referred to as "normal" fuel injection amount Ti which is indicated in the following equation.

$$Ti = Tp \times (1 + KTW + KAS + KAi + KMR) \times KFC \times \alpha + Ts \quad (1)$$

$$Tp = Q/N \times K$$

where

Tp: reference fuel injection amount
Q: intake air flow
N: engine revolution
K: constant
Ti: normal fuel injection amount
KTW: increasing compensation coefficient for water temperature
KAS: increasing compensation coefficient for starting and after starting
KAi: increasing compensation coefficient after idling
KMR: air-fuel ratio compensation coefficient
KFC: fuel cut coefficient
$\alpha$: air-fuel ratio feedback compensation coefficient
Ts: voltage compensation The fuel injection amount is normally determined according to the above equation. Moreover, with fuel under a predetermined pressure applied to the fuel injection valve 6, the timing for opening the injection valve is set corresponding to the 120° signal and the duration for opening the injection valve is determined corresponding to the Ti, so that the fuel corresponding to intake air flow per unit revolution can be supplied to maintain the air-fuel ratio of the mixture applied to the engine at a predetermined value. Such arithmetic operation is effected according to a program housed in the ROM 205.

An output circuit 206 converts the signal Ti into a time signal for the fuel injection valve. The output circuit 206 consists of a register 301, a comparator 302, a counter 303, a frequency divider circuit 304 and a flip-flop circuit 305 as shown in FIG. 5. The register 301 receives fuel injection amount signals from the CPU 204. At first the 120° signal is three divided in the frequency divider circuit 304 whose output sets the flip-flop circuit 305 and then actuates the counter 303 to start counting clock pulses. If the counted value is coincident with the content in the register 301, then the comparator 302 produces a coincidence signal to reset the flip-flop 305 and then to reset the counter 303, thereby stopping the counting.

With this arrangement, it is possible to convert the fuel injection amount signal into a fuel injection time signal at the timing of three times of 120°, that is, 360°, which signal is amplified in the amplifier circuit 207 to drive the fuel injection valve. The signals are transmitted between the CPU 204 and the respective components through buses 208.

Figure 6:
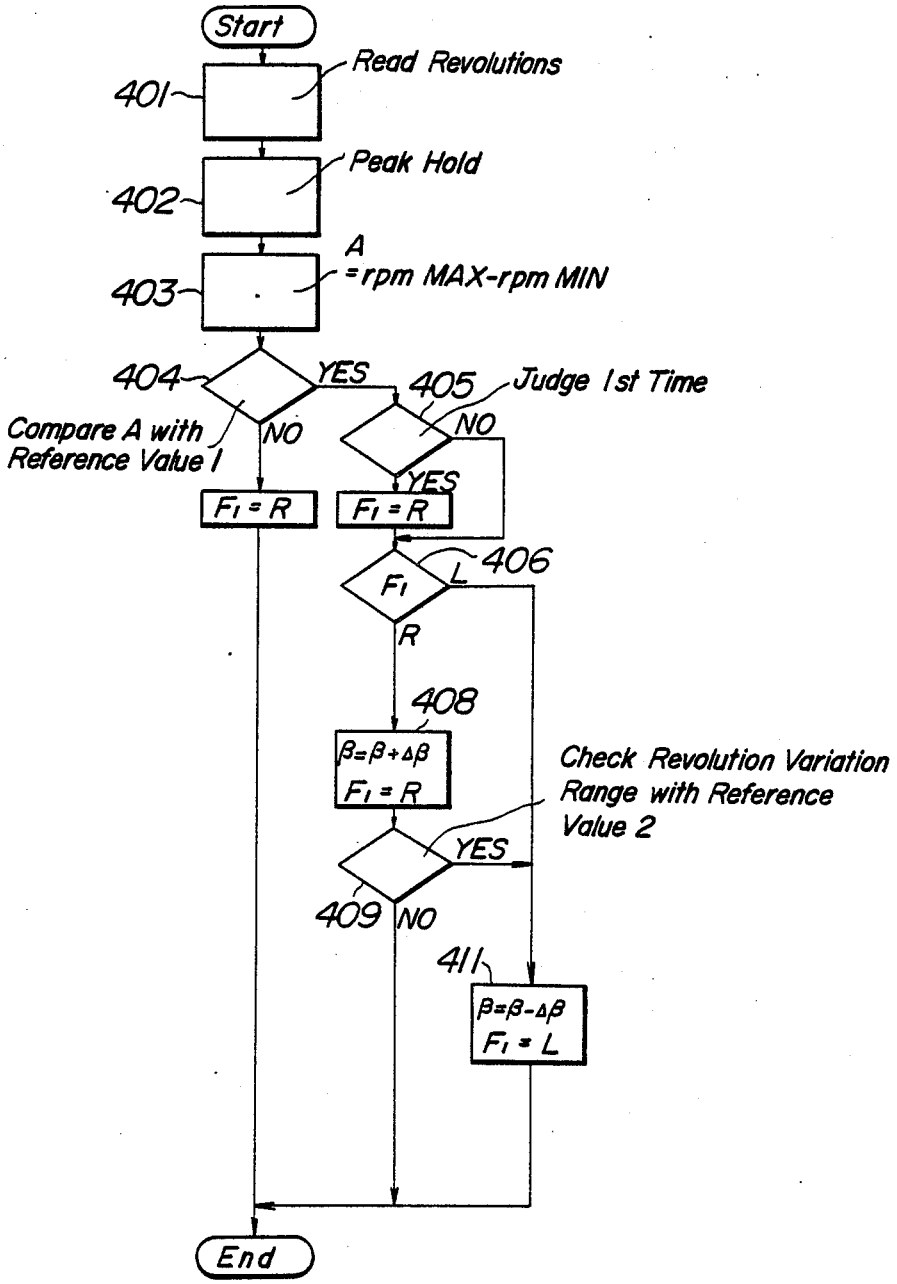
FIG. 6 is a flow chart explaining a compensation of air-fuel ratio depending upon rpm variation ranges.

A method of detecting rpm variation ranges and a compensation of air-fuel ratio corresponding to revolution variation range will be explained with reference to FIG. 6 illustrating a flow chart showing steps of control program which is housed in the ROM 205 shown in FIG. 4. It is assumed that this program is started every one second. At first, rpm information calculated in the input circuit is read (401). In this manner, the maximum (rpm MAX) and minimum (rpm MIN) of the read rpm data are repeatedly obtained to renew the data in succession (402). Then an rpm variation width A is obtained from a subtraction of the rpm MAX and rpm MIN (403). Thereafter, the revolution variation width A is compared with the first reference value. If the width A is less than the reference value, the FLAG F1 is set at R to complete the process. If the width A is more than the first reference value, it is recognized that the rpm variation range is large, and then the process proceeds to step 405. In the step 405, it is judged whether the step is being performed for the first time. If it is the first time, the FLAG F1 is set at R. A step 406 checks the condition of the FLAG F1. The FLAG F1 serves to determine whether the control moves toward a rich side or lean side when it is judged that the rpm variation range is great. In case of FLAG F1=R, in a step 408 the air-fuel ratio is moved to the rich side (to increase $\beta$) and the FLAG F1 is set at R. The method of controlling the ratio toward the rich side will be explained later.

In a step 409, a revolution variation range after the air-fuel ratio has become enriched is checked. This comparison judges whether the rpm variation range increased or not. In other words, the range is compared with the second reference value which is more than the first reference value. If it is more than the second reference value, it is recognized that the variation range has increased and the control proceeds to step 411. If it is less than the second reference value, the process is completed. In the step 411, the air-fuel ratio is moved to the lean side (to decrease $\beta$) at a predetermined time constant and the FLAG F1 is set at L to complete the process.

How to control the air-fuel ratio to rich or lean will be explained hereinafter.

An air-fuel ratio compensation coefficient $\beta$ due to the rpm variation is added to the above equation (1) to obtain the following second equation (2).

$$Ti = Tp \times (1 + KTW + KAS + KAi + KMR) \times KFC \times \alpha \times \beta + Ts \quad (2)$$

A predetermined value is given to the $\beta$ as an initial value and in the steps 408 and 411 a predetermined value is added to or subtracted from the value of the $\beta$ to increase or decrease the $\beta$ and hence Ti, thereby changing the fuel injection amount to control the mixture toward the rich or lean.

In this manner, if an rpm variation range is more than the predetermined value, the mixture is controlled toward the rich and as the result if the range is increased, the mixture is controlled toward the lean side, thereby enabling the air-fuel ratio of mixture to be set so as to minimize the rpm variation range.

As can be seen from the above description, the device according to the invention eliminates the uncomfortable variation in revolution when idling to improve the maneuverability and comfortability of vehicles.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An idling rpm control device for an internal combustion engine for controlling idling rpm thereof depending upon operating parameters thereof, comprising:

(a) a revolution sensor for producing signals indicative of engine revolutions;

(b) rpm range detecting means for detecting a range of variations in idling rpm of the engine, said range detecting means comprising a range detecting circuit for receiving said signals from said revolution sensor and generating a signal corresponding to a range of variations in rpm of the engine; and (c) fuel control means for changing a fuel-air ratio of mixture to decrease said range of variations in idling rpm, said fuel control means comprising a change control circuit for generating signals for changing the fuel-air ratio of mixture when said signal from said range detecting circuit is more than a determined value, and a fuel control circuit for changing the fuel-air ratio of mixture in response to the signal from said change control circuit and receiving signals corresponding to parameters from a temperature sensor for detecting temperature of the engine, said revolution sensor for detecting revolutions of the engine and an intake air flow sensor for detecting intake air flow rate to generate driving pulses for actuating a fuel injection valve.

2. An idling rpm control device as set forth in claim 1, wherein said fuel control circuit comprises a frequency divider circuit receiving revolution signals from said revolution sensor for the engine, a first charging and discharging circuit receiving signals from the frequency divider circuit having pulse width corresponding to the engine rpm and signals from an intake air flow sensor and generating signals corresponding to reference fuel injection amounts determined by the engine rpm and intake air flow, a second charging and discharging circuit receiving said signals from the first charging and discharging circuits, signals from a cooling water temperature sensor and signals from said control circuit of said fuel control means to generate pulse signals, an adder circuit receiving the signals from said second charging and discharging circuit for adding the fuel amount depending upon battery voltages and generating signals and an amplifier circuit for amplifying the signals from the adder circuit and feeding the amplified signals to a fuel injection valve; said range detecting circuit comprises a period/voltage converter circuit for converting periods of said revolution signals into voltage signals, first and second peak hold circuits receiving said voltage signals from said period/voltage converter circuit and holding maximum and mimimum values of said voltage signals, respectively, and a differential amplifier for obtaining differences between outputs of said peak hold circuits; and said control circuit of said fuel control means comprises a first comparator for comparing outputs from said differential amplifier with a first reference value to produce high and low level signals depending upon whether the outputs from said differential amplifier are more or less than said first reference value, a second comparator for comparing said outputs from said differential amplifier with a second reference value when said first comparator generates the high level signal, a change-over circuit for generating three kinds of signals depending upon high or low levels of outputs from said first and second comparators, an integration circuit for generating signals depending upon said three kinds of signals, and an adding and subtracting circuit for adding and subtracting a predetermined voltage from outputs of said integration circuit to produce signals which are inputted into said second charging and discharging circuit.

3. An idling rpm control device as set forth in claim 1, wherein said rpm range detecting means and said fuel control means comprises a multiplexer for selecting analog signals from a temperature sensor and an intake air flow sensor to generate signals, an analog-to-digital converter for converting the signals from the multiplexer to digital signals, an input circuit for counting signals from said revolution sensor of the engine during a predetermined period of time, a central processing unit for determining fuel injection amount, and an output circuit for converting a signal of said fuel injection amount into a duration signal.

4. An idling rpm control device as set forth in claim 3, wherein said output circuit comprises a register, comparator, a counter, a frequency divider circuit and a flip-flop circuit.

* * * * *